US006018893A

United States Patent [19]

Workman

[11] Patent Number: 6,018,893

[45] Date of Patent: Feb. 1, 2000

[54] ATHLETIC SHOE HAVING NOTCHED CLEATS

[75] Inventor: Steve Workman, Clackamas, Oreg.

[73] Assignee: Adidas International B.V., Germany

[21] Appl. No.: 08/826,597

[22] Filed: Apr. 3, 1997

[51] Int. Cl.[7] ..... A43C 15/16; A43C 15/00; A43B 5/00

[52] U.S. Cl. ..... 36/134; 36/67 R

[58] Field of Search ..... 36/134, 67 A, 36/67 B, 67 D, 67 R

[56] References Cited

U.S. PATENT DOCUMENTS

| | | | |
|---|---|---|---|
| 1,423,445 | 7/1922 | Magaldi | 36/67 A |
| 3,859,739 | 1/1975 | Dassler | 36/67 D |
| 3,898,751 | 8/1975 | Gustin | 36/67 D |
| 4,233,759 | 11/1980 | Bente et al. | 36/67 A |
| 4,327,503 | 5/1982 | Johnson | 36/67 A |
| 4,748,750 | 6/1988 | George | 36/67 R |
| 5,505,012 | 4/1996 | Walker et al. | 36/134 |

*Primary Examiner*—M. D. Patterson

*Attorney, Agent, or Firm*—Marger Johnson & McCollom, P.C.

[57] ABSTRACT

An athletic shoe is including an outer sole having at least one notched cleat of resilient material molded integral or removable to the lower surface of the shoe sole. In one embodiment, a plurality of notched cleats are disposed throughout the shoe sole. In a second embodiment, a plurality of notched cleats extend outwardly from and are disposed along the perimeter of the sole. Both embodiments provide an improved measure of lateral stability. The notch defining surfaces of the cleat act as teeth to cut through and displace the ground to provide good traction under wet or dry conditions on soft or hard surfaces. A plurality of other cleats of different shapes and ground-engaging surface areas than the notched cleats may also be molded integral or removable to the outer sole. The athletic shoe is for use in sports such as football, soccer, baseball, or ultimate frisbee played on natural grass, dirt, or other soft or hard surfaces.

12 Claims, 1 Drawing Sheet

ATHLETIC SHOE HAVING NOTCHED CLEATS

BACKGROUND OF THE INVENTION

This invention relates generally to athletic shoes having cleated soles, and in particular to athletic shoes in which the cleats are axially notched.

Cleats are provided on athletic shoes to provide improved traction, usually on natural surfaces. The prior art teaches various examples of cleat arrangements on the sole of athletic shoes. U.S. Pat. No. 3,793,750 to Bowerman, teaches an athletic shoe having a sole with integrally molded resilient studs or cleats. U.S. Pat. No. 3,932,950, to Taber teaches a shoe with a sole having a large number of small closely spaced cylindrical or conical cleats.

While the cleated shoes taught in the prior art provide greater traction on natural surfaces than uncleated shoes, their performance is nonetheless limited by the degree of "ground penetration" achieved by the cleats.

SUMMARY OF THE INVENTION

The present invention overcomes the inherent limitations of cleated shoes taught in the prior art by providing a cleated shoe having improved ground penetration on natural surfaces, and therefore improved traction.

A shoe according to the present invention includes an upper and a sole. At least one axially notched cleat extends downwardly from the sole, although the preferred embodiment includes multiple notched cleats. The notched cleats are preferably molded as an integral part of the sole, but the invention is not limited thereto. The cleats could be permanently or removably affixed to the sole by either an adhesive, or by mechanical means. In one embodiment, a plurality of notched cleats are disposed around the periphery of the sole. Notched or unnotched cleats are provided on sole inboard of the peripheral notched cleats. The cleats are preferably tapered from the sole to the distal end, although the invention is not limited thereto. The cleat can be rounded, rectangular, triangular, or of other cross-sectional shape. The distal end is preferably crowned to facilitate ground penetration.

The notches in the cleats are preferably V-shaped, with the surfaces forming the notches oriented at about 90 degrees relative to each other. In alternative embodiments, the notches curved.

The foregoing and other objects, features, and advantages of the invention will become more readily apparent from the following detailed description of the preferred embodiment of the invention which proceeds with reference to the accompanying drawings.

DETAILED DESCRIPTION

Figure 1:
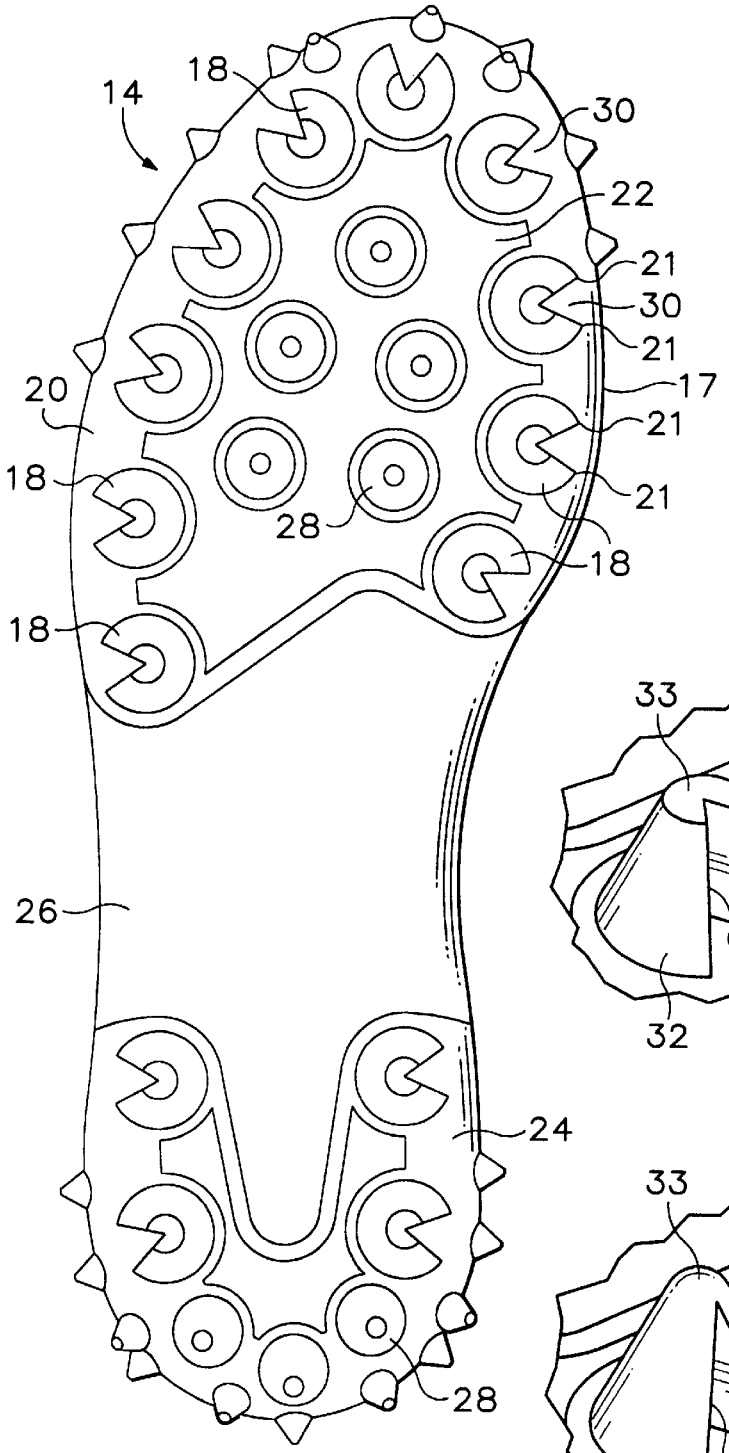
FIG. 1 is a bottom plan view of a preferred embodiment of a shoe sole, including notched cleats, according to the present invention.
Figure 2:
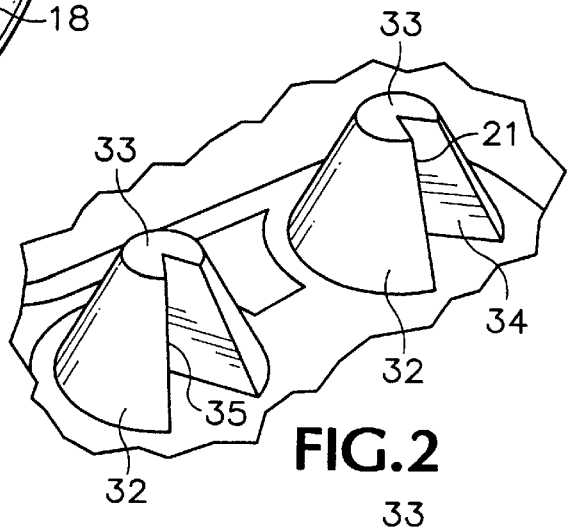
FIG. 2 and FIG. 3 are a perspective side view of a preferred embodiment of a tapered cleat with a V-shaped notch.
Figure 3:
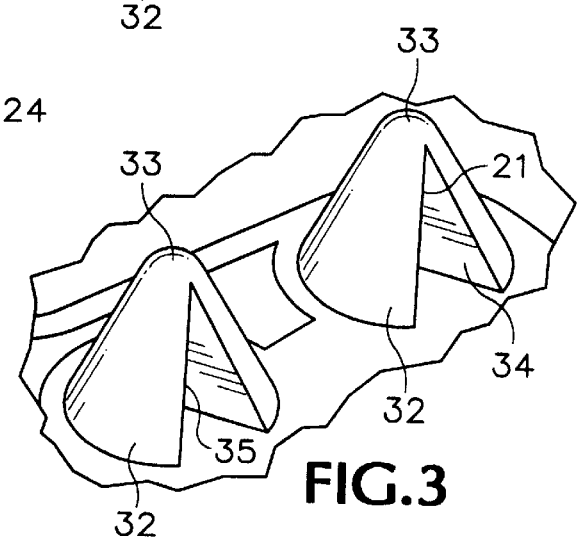

Turning now to FIG. 1, a shoe according to the present invention is shown generally at 10. Shoe 10 includes an upper 12 and a cleated sole 14 attached to the bottom side thereof. Sole 14 is formed of rubber or other suitable abrasion resistant materia known to those skilled in the art. Sole 14 includes a bottom surface 16 and a periphery 17. While it is well-known to enhance the traction of the shoe on natural surfaces by providing cleats which protrude from the sole, applicant has discovered that the enhanced traction provided by the cleats can be further improved if the cleats are formed with axial slots formed therein. One embodiment of a notched cleat is shown in FIGS. 1 and 2 at 18. Cleat 18 of the embodiment shown is frustaconical in shape with an axial notch 19 formed therein. Cleat 18 could be frusta-pyramidical or cylindrical in shape, for example. Distal end 33 of cleat 18 is flat in the embodiment of FIGS. 1 and 2, but could be rounded, pointed, could include ridges or other protrusions, or could be recessed in alternate embodiments. Notch 19 of the embodiment shown in FIGS. 1 and 2 is an acute V-shape. In other embodiments, notch 19 could be more or less acute, right-angled, obtuse, or even curved without departing from the scope of the claimed invention.

In the preferred embodiment, a plurality of notched cleats 18 are provided on both the forefoot and heel regions of the shoe just inboard of periphery 17. Additional unnotched cleats are provided on the interior portions of the sole as well. In the embodiment shown, the notched cleats 18 are oriented so that the notch 19 faces outwardly toward the peripheral edge of the shoe. In this way, the relatively sharp edges of the cleat, which most readily penetrate the ground, are positioned to do so as the wearer pushes off. For example, the wearer of the right shoe shown in FIG. 1 who cuts to the left pushes off of the medial edge of the right shoe. As the wearer does so, the pointed portions 21 of the cleated notches 18 along the medial edge of the sole are driven into the ground, facilitating the penetration of the cleat and maximizing traction. As an added benefit, the notched cleats' reduced overall volume further aids in maximizing the penetration of the cleat. With the particular arrangement of FIG. 1, when the wearer pushes of in any direction, the pointed portions of at least one, and in most cases several cleats are oriented to provide quick and sure traction. Those skilled in the art will recognize that other arrangements and orientations and combinations of notched and unnotched cleats are possible without departing from the scope of the invention.

FIG. 2 is a perspective view of one embodiment of the invention in which the notched cleat is generally frustaconical in shape. In other embodiments, the cross-sectional shape of the cleat may include three, four, five, or more flat surfaces, and may be untapered as well. Notched cleat 18 may be integrally molded with the sole, or can be removable for replacement or substitution to optimize the shoe for different surfaces and personal preferences of the wearer.

From the foregoing description of the preferred embodiment herein described, it will be apparent to those skilled in the art that the cleated sole of the present invention affords many advantages over the prior art. Although the preferred embodiment of the invention has been described in detail, it will be appreciated that other alternative embodiments and modifications thereof are within the spirit and scope of the invention as defined by the appended claims.

What is claimed is:

1. A shoe sole comprising:

a lower surface;

a peripheral edge; and a plurality of cleats extending downwardly from the lower surface of the sole, including at least one notched cleat having a body, having surfaces defining a single axial notch, the single notch having first and second peripheral axial edges, and a convex, frusto-conical surface connecting the first and second peripheral axial edges of the notch.

2. A shoe sole according to claim 1 wherein the body of the at least one notched cleat is tapered.

3. A shoe sole according to claim 1 wherein the cross-sectional shape of the at least one notched cleat includes at least two straight lines which form an angle.

4. A shoe sole according to claim 1 wherein the surfaces defining the axial notch are planar.

5. A shoe sole according to claim 1 wherein the shape of the notched cleat distal end is rounded.

6. A shoe sole according to claim 1 wherein the at least one notched cleat is adjacent the peripheral edge of the sole.

7. A shoe sole according to claim 1 wherein the notch faces the peripheral edge of the sole.

8. A shoe sole comprising:

a lower surface with front, rear, lateral, and medial sides; and at least one notched cleat extending downwardly from said lower surface, the at least one notched cleat having an axial length, a first axial surface, a second axial surface, and the first axial surface defining an axial notch in the at least one notched cleat, and a continuous frusto-conical peripheral surface having first and second axial edges, and first and second surfaces adjacent to the respective first and second peripheral surface axial edges defining a single axial notch.

9. A shoe sole according to claim 8 wherein the first and second surfaces comprise a pair of adjacent planar surfaces.

10. A shoe sole according to claim 8 wherein the at least one notched cleat is tapered.

11. A shoe sole according to claim 10 wherein the at least one notched cleat is adjacent the peripheral edge of the sole.

12. A shoe sole according to claim 10 wherein the notch faces the peripheral edge of the sole.

* * * * *